US011193263B1

(12) United States Patent
Bensing et al.

(10) Patent No.: US 11,193,263 B1
(45) Date of Patent: Dec. 7, 2021

(54) FASTENER COVER FOR BIDET ATTACHMENT

(71) Applicant: Tushy, Inc., Brooklyn, NY (US)

(72) Inventors: Zac Bensing, Brooklyn, NY (US); Gaute Nordby, Brooklyn, NY (US)

(73) Assignee: Tushy, Inc., Brooklyn, NY (US)

( * ) Notice: Subject to any disclaimer, the term of this patent is extended or adjusted under 35 U.S.C. 154(b) by 0 days.

(21) Appl. No.: 16/988,138

(22) Filed: Aug. 7, 2020

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/252.1, 285, 56, 64, 643; 285/56, 64
See application file for complete search history.

(56) References Cited

U.S. PATENT DOCUMENTS 3,781,919 A * 1/1974 Ayala ..... E03D 9/08 4/447
4,135,255 A * 1/1979 Menendez ..... E03D 9/08 4/448
4,406,025 A * 9/1983 Huck ..... E03D 9/08 4/420.2
4,596,058 A * 6/1986 Nourbakhsh ..... E03D 9/085 4/420.1
4,807,311 A * 2/1989 Ingels ..... E03D 9/08 4/420.4
4,967,423 A * 11/1990 Aoyama ..... E03D 9/08 239/588
4,995,121 A * 2/1991 Barker ..... E03D 9/085 4/420.2
4,998,300 A * 3/1991 Sharifzadeh ..... E03D 9/08 4/420.4
5,361,427 A * 11/1994 Wilk ..... E03D 9/085 4/420.3
5,495,625 A * 3/1996 McGuire ..... E03D 9/08 4/420.2
5,566,402 A * 10/1996 Agha el-Rifai ..... E03D 9/08 4/420.4
5,911,516 A * 6/1999 Chang ..... E03D 9/08 4/420.2
6,192,527 B1 * 2/2001 Paul ..... E03D 9/08 4/420.4
2014/0259351 A1 * 9/2014 Spankowski ..... E03D 11/02 4/420.5
2018/0258627 A1 * 9/2018 Roxas ..... E03D 9/085
2020/0109546 A1 * 4/2020 Verzone ..... E03D 9/085

* cited by examiner

*Primary Examiner* — Lori L Baker
(74) *Attorney, Agent, or Firm* — Mark Terry

(57) ABSTRACT

A fastener for fastening a bidet attachment to a toilet bowl is provided. The fastener has a base disc with a first elongated slot, and depressions on a top surface of the base disc. The base disc is configured for placement within a depression of the middle disc, which has a second elongated slot commensurate with the first elongated slot, a depression on a top surface of the middle disc, and protrusions on a bottom surface of the middle disc. Protrusions are configured to fit within the depressions when the middle disc is connected to the base disc. The fastener also has a top element configured to fit within the depression on the top surface of the middle disc, a third elongated slot commensurate with the first elongated slot, a portion of elastomeric material spanning the third elongated slot, and a slit located in the portion of elastomeric material.

14 Claims, 10 Drawing Sheets

FASTENER COVER FOR BIDET ATTACHMENT

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to bathroom plumbing fixtures and appliances and, more specifically, to bidet attachments for toilets.

BACKGROUND

A toilet seat is a hinged unit consisting of a round or oval open seat, and usually a lid, which is bolted onto the bowl of a toilet used in a sitting position (as opposed to a squat toilet). A toilet seat consists of the seat itself, which may be contoured for the user to sit on, and the lid, which covers the toilet when it is not in use. The seat is generally lifted when a man stands to urinate, or while cleaning the toilet.

A bidet is a bowl or receptacle designed to be sat on for the purpose of washing the human genitalia, perineum, inner buttocks, and anus. The modern variety includes a plumbed-in water supply and a drainage opening and is thus a type of plumbing fixture. The bidet is designed to promote personal hygiene, and is used after defecation, and before and after sexual intercourse. There are bidets that are attachable to toilet bowls, also called "bidet attachments", or "add-on bidets". Bidet attachments may be mounted directly to the toilet and may be situated below the toilet seat. Bidet attachments may be controlled mechanically by turning a valve, which activates a jet of water. Further refinements include adjustable water pressure, temperature compensation, and directional spray control.

One of the problems associated with toilet seats and bidet attachments involves cleanliness. Both toilet seats and bidet attachments require that they are attached to the toilet bowl using nuts and bolts that extend through a pair of holes (i.e. fastener holes) in the rear of the toilet bowl. Exposed nuts and bolts create a series of nooks and crevices in which urine, debris, dust and other unwanted material may accumulate. Further, it may be difficult to clean within said nooks and crevices with a conventional sponge or brush.

Another problem associated with toilet seats and bidet attachments involves the placement of the fastener holes in the toilet seat. Recall that both toilet seats and bidet attachments require that they are attached to the toilet bowl using nuts and bolts that extend through a pair of fastener holes in the rear of the toilet bowl. But the distance between the fastener holes and the distance between the inner edge of the toilet bowl may differ from toilet bowl to toilet bowl. Therefore, it can be difficult and cumbersome to attach a toilet seat or bidet attachment to a toilet bowl when the placement of the fastener holes varies. Sometimes, adapters must be used, or the toilet bowl must be otherwise modified to accommodate attachment of a toilet seat or bidet attachment. In other instances, certain toilet seat or bidet attachments simply cannot be used with certain toilet bowls. This reduces the usability of the toilet seats or bidet attachments.

Therefore, a need exists for improvements over the prior art, and, more particularly, for cleaner methods of attaching toilet seats and bidet attachments to toilet bowls, and for a universal method of attaching toilet seats and bidet attachments to a variety of different toilet bowls.

SUMMARY

A fastener for fastening a bidet attachment to a toilet bowl is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a fastener for fastening a bidet attachment to a toilet bowl is disclosed. The fastener has a base disc having a first elongated slot, and two or more depressions on a top surface of the base disc, where the base disc is configured for placement within a circular depression. The fastener also has a middle disc having a second elongated slot commensurate with the first elongated slot, a substantially oval depression on a top surface of the middle disc, and two or more protrusions on a bottom surface of the middle disc, where each of the two or more protrusions are configured to fit securely within the two or more depressions when the middle disc is connected to the base disc. Finally, the fastener for fastening a bidet attachment to a toilet bowl has a top element having a substantially oval shape configured to fit securely within the oval depression on the top surface of the middle disc, a third elongated slot commensurate with the first elongated slot, a portion of elastomeric material substantially spanning the third elongated slot, and a slit located in the portion of elastomeric material.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the claimed subject matter and together with the description, serve to explain the principles of the disclosed embodiments. The embodiments illustrated herein are presently preferred, it being understood, however, that the invention is not limited to the precise arrangements and instrumentalities shown, wherein:

DETAILED DESCRIPTION

Figure 1:
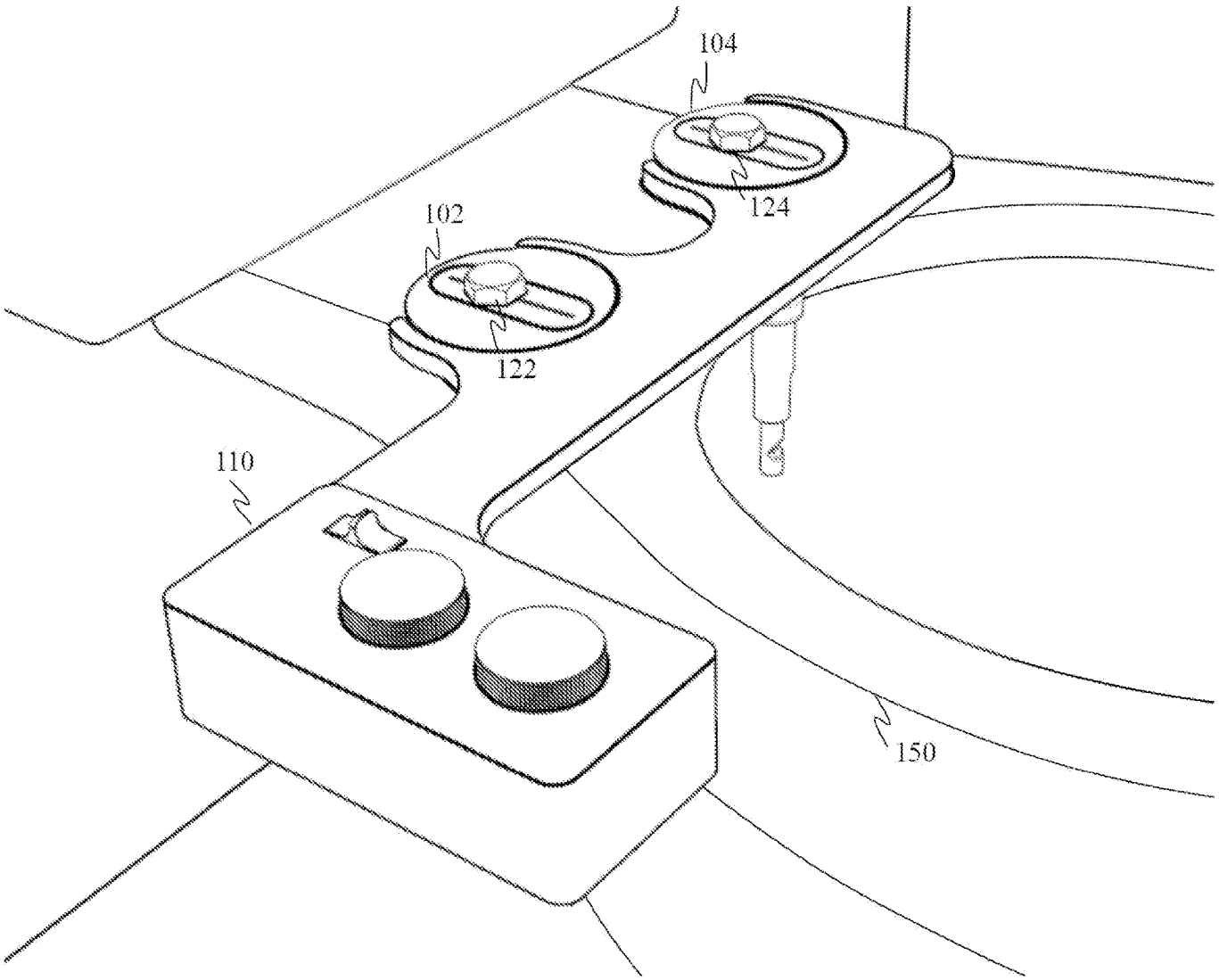
FIG. 1 is the front perspective view of a bidet attachment system including a bidet attachment and a pair of fasteners, according to an example embodiment.

The following detailed description refers to the accompanying drawings. Wherever possible, the same reference numbers are used in the drawings and the following description to refer to the same or similar elements. While embodiments herein may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed embodiments improve upon the prior art by providing an apparatus optimized for a variety of toilets while providing a cleaner device and providing an aesthetic appeal to consumers. Current bolt covers may impair the functionality of the bidet attachment, frustrating end users, while making the bidet attachment difficult to clean. The claimed embodiments deal with this problem using a unique three-part design, made from easy-to-clean components that provide for a versatile and easily adjustable mounting unit designed to fit a wide variety of toilet sizes, shapes and toilet bowl fastener hole distances. Specifically, the claimed embodiments provide an apparatus for covering bidet attachment bolts by adjusting the length of the slot, via the circular design which allows for the flange to be freely rotated and fit a variety of toilet bowl fastener hole distances while being easy to clean and preventing urine, debris and other undesirable matter from entering into the bolt slot cavity. Therefore, the claimed embodiments allow for an aesthetically pleasing bidet attachment fastener apparatus to be utilized in a manner that would seamlessly fit a variety of toilet bowls, while providing a surface that is easy to clean, without impairing the functionality of the bidet attachment.

Now referring to the figures, FIG. 1 is a perspective view of a bidet attachment system including a bidet attachment 110 and a pair of bidet attachment fasteners 102, 104. FIG. 1 shows the bidet attachment fasteners 102, 104 on a bidet attachment 110, used to secure the bidet attachment to a conventional toilet 150. FIG. 1 shows that a bolt 122 extends through the bidet attachment fastener 102 to attach the bidet attachment 110 to the toilet 150. FIG. 1 also shows that a bolt 124 extends through the bidet attachment fastener 104 to attach the bidet attachment 110 to the toilet 150.

Each fastener 102, 104 is located within a circular depression in the bidet attachment 110. Each fastener 102, 104 may be rotated within the circular depression in the bidet attachment 110, so as to vary the orientation of the slots (in each fastener) in relation to each other. As the orientation of the slots is varied, so is the distance between the slots, and the locus of possible positions of the bolts within the slots. This feature allows for the placement of the bidet attachment 110 on toilets with bolt holes at different distances from one another, at different distances from the bowl of the toilet, and at different distances from the tank of the toilet. Each portion of the bidet attachment fasteners is further disclosed in the additional accompanying drawings and discussed in further detail below.

Figure 2:
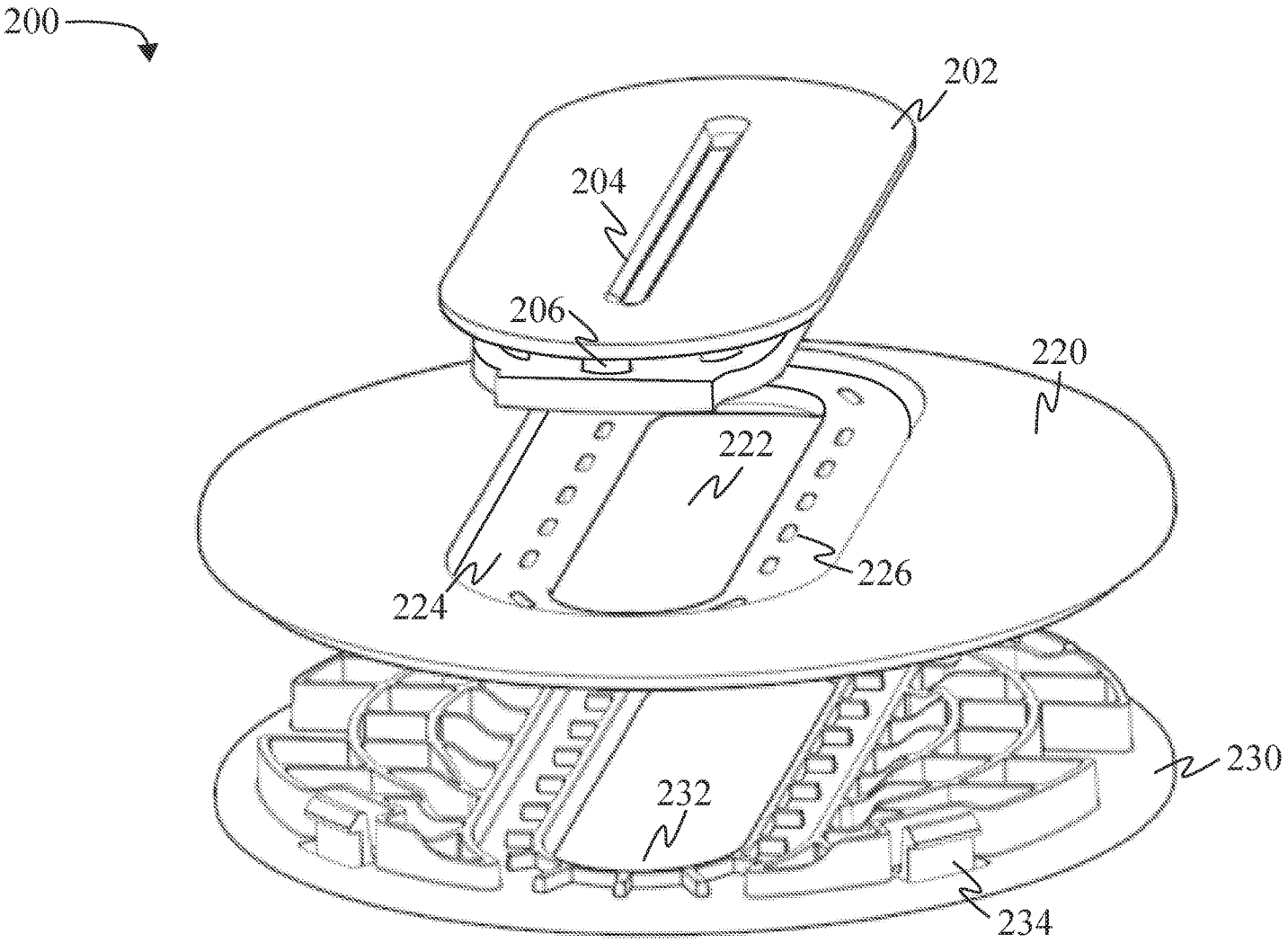
FIG. 2 is an exploded view of a bidet attachment fastener, according to an example embodiment.

FIG. 2 is an exploded view of the bidet attachment fastener 200 shown in FIG. 1 as bidet attachment fasteners 102, 104. FIG. 2 depicts a substantially oval top element 202, including an elongated slot 208 (not shown in FIG. 2 but seen in FIG. 10) dorsally located adjacent to a slit 204 located substantially in the center of the top element, which allows a coupling bolt (such as 122, 124) to pass through the top element unhindered.

The top element 202 of the bidet attachment fastener 200 may be composed of an elastomeric material that is malleable enough to wrap around installed coupling bolts while minimizing the exposed cavity, preventing buildup therein. The material may also have high fatigue strength to prevent cracking or breaking down over prolonged use. The material used may include natural or synthetic rubbers classified as soft on the rubber durometer scale. The top element 202 may further include a plurality of protrusions 206 on a bottom surface of the top element, wherein the plurality of protrusions are configured to fit securely within a plurality of orifices 226 in the depression 224 on the top surface of the middle disc 220.

FIG. 2 further depicts a middle disc 220 with an elongated slot 222 commensurate with the elongated slot 208 (see FIG. 10) of the top element 202 and the elongated slot 232 of the base disc 230. The middle disc includes a substantially oval depression 224 located on the top side of the disc to allow a coupling bolt to pass through the middle disc. The substantially oval depression is shaped to match the shape of the top element 202 such that the top element fits securely within the depression, making a friction fit. Middle disc 220 also includes two or more holes or orifices 226 for the secure interlocking of the top element 202 using the rubber protrusions 206 located on the bottom side thereof. FIG. 2 also depicts a base disc 230 including an elongated slot 232 commensurate with the elongated slots of the top element 202 and middle disc 220.

Figure 3:
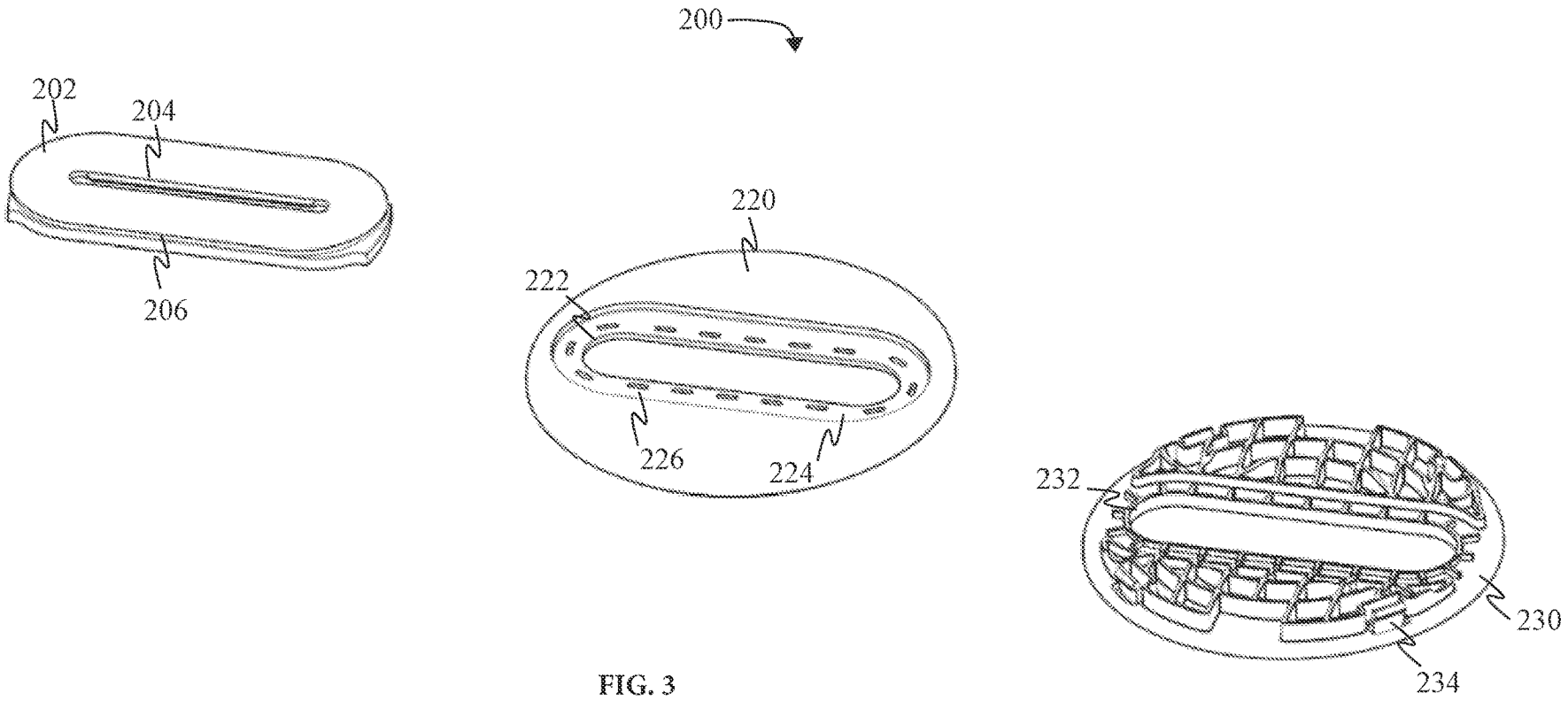
FIG. 3 is another exploded view of the bidet attachment fastener, according to an example embodiment.

FIG. 3 shows another exploded view of the bidet attachment fastener 200. FIG. 3 further demonstrates the commensurate nature of the elongated slots of the middle and base discs (222, 232), and other crucial components of each portion, further described below.

Figure 4:
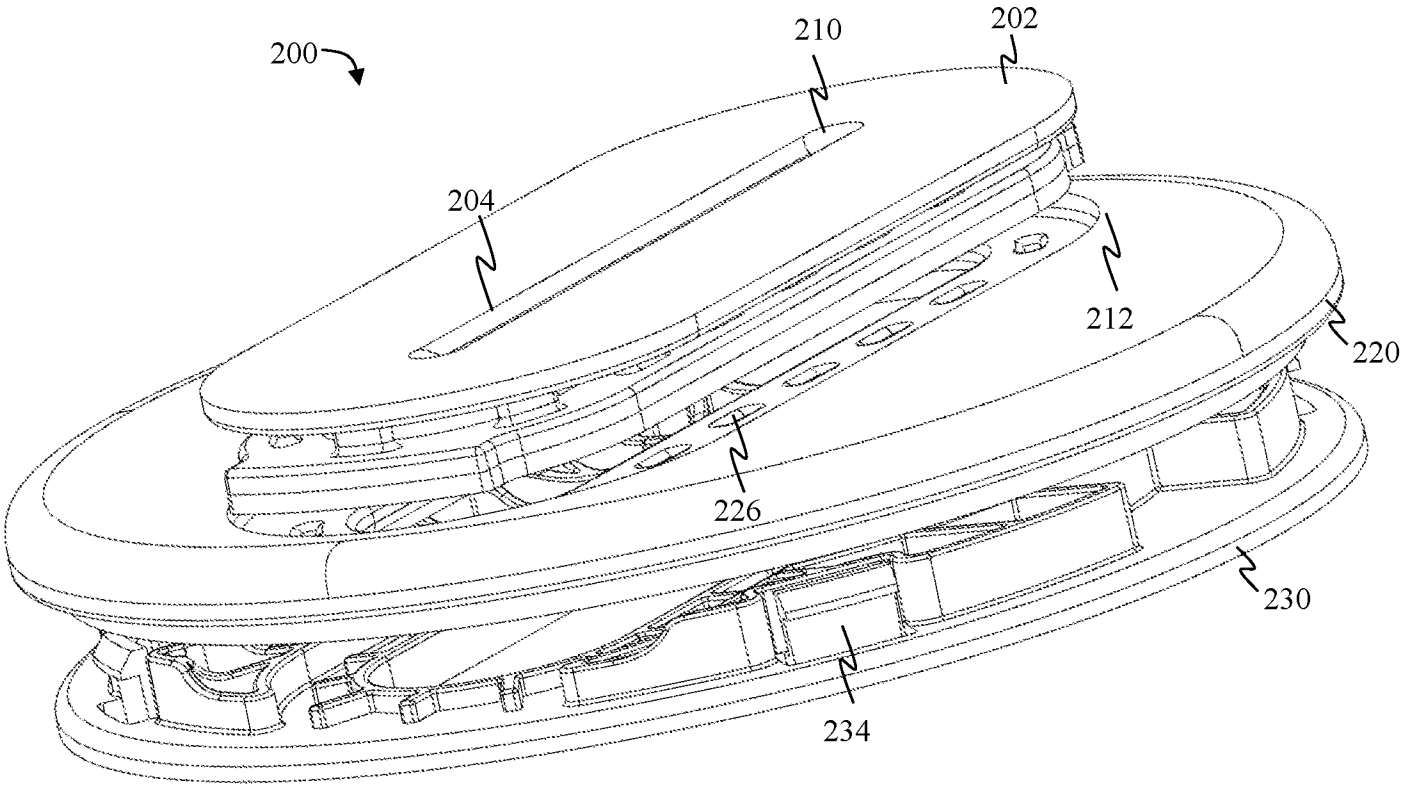
FIG. 4 is a top perspective view of a bidet attachment fastener, according to an example embodiment.
Figure 5:
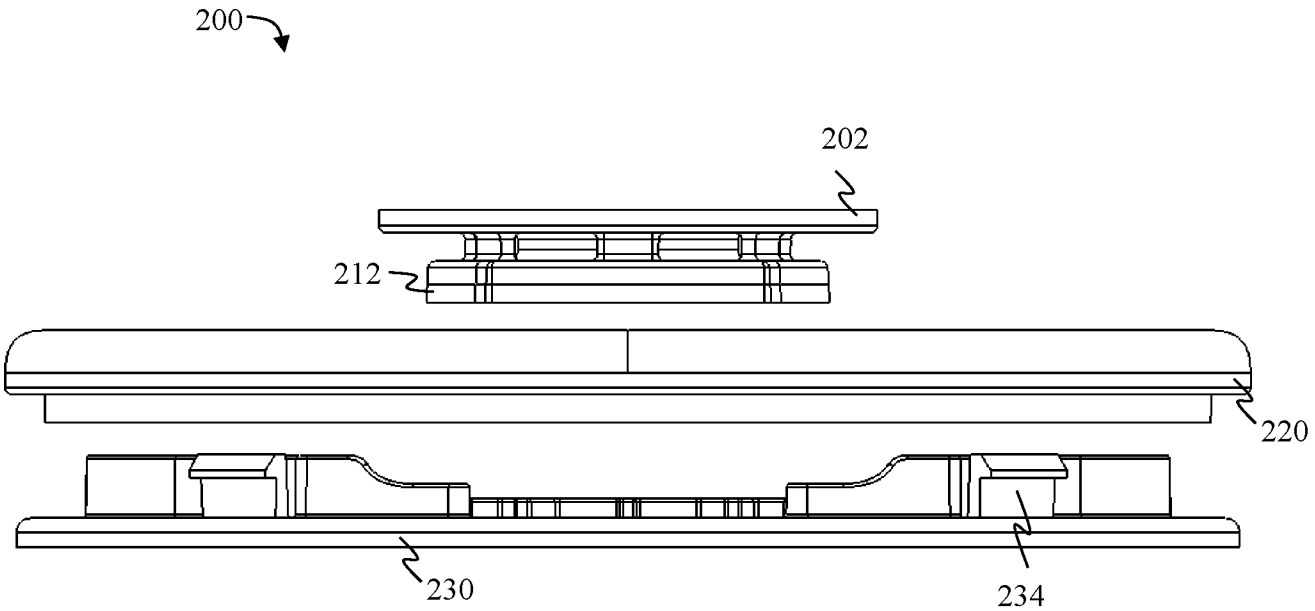
FIG. 5 is a side view of a bidet attachment fastener, according to an example embodiment.
Figure 6:
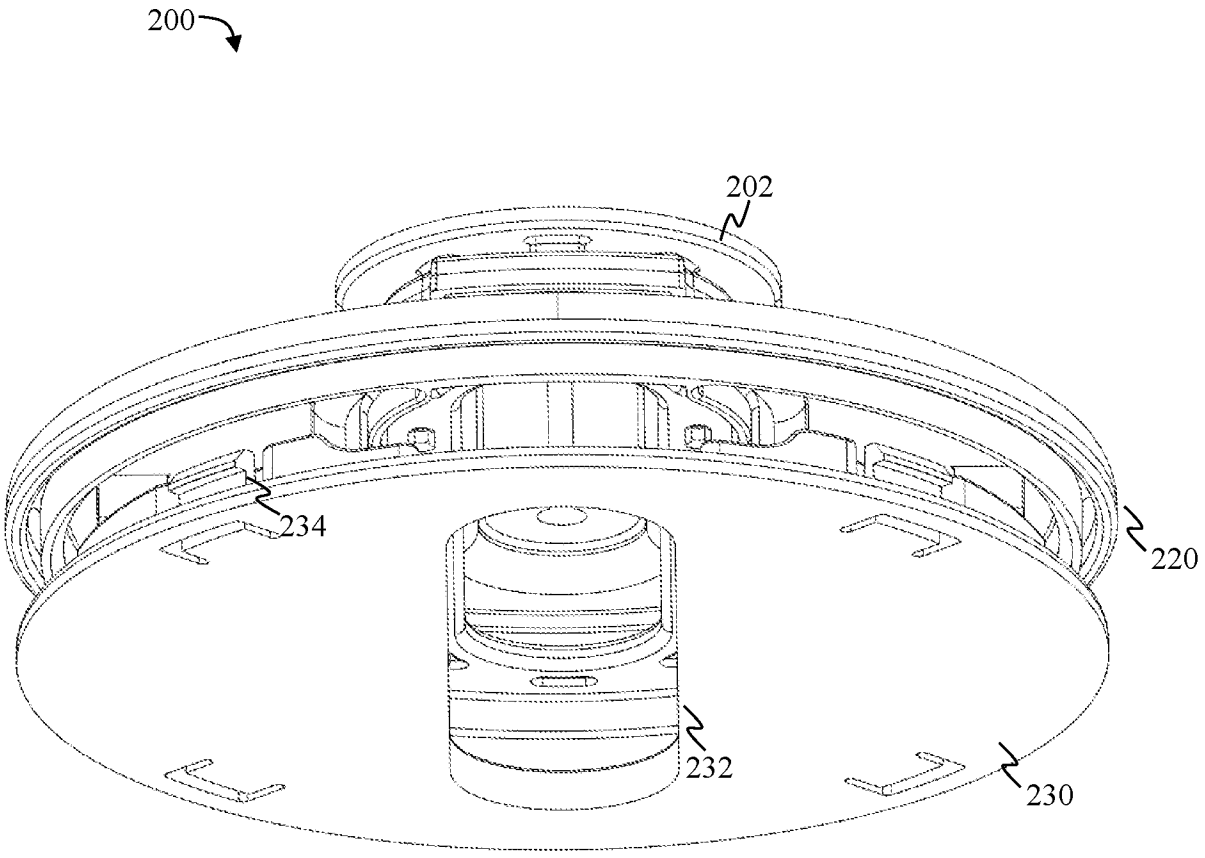
FIG. 6 is a bottom perspective view of a bidet attachment fastener, according to an example embodiment.

FIGS. 4, 5, and 6 are further views of the bidet attachment fastener 200, partially disassembled to depict the method of constructing the bidet attachment fastener, as well as the components of each portion that facilitate the construction of the bidet attachment fastener. FIG. 4 shows the apparatus in a perspective view of the top of the apparatus, FIG. 5 shows a side view thereof, and FIG. 6 shows a perspective view of the bottom of the apparatus.

Figure 7:
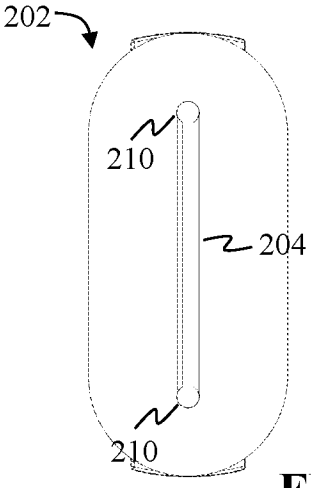
FIG. 7 is a front view of the top element for the bidet attachment fastener, according to an example embodiment.
Figure 8:
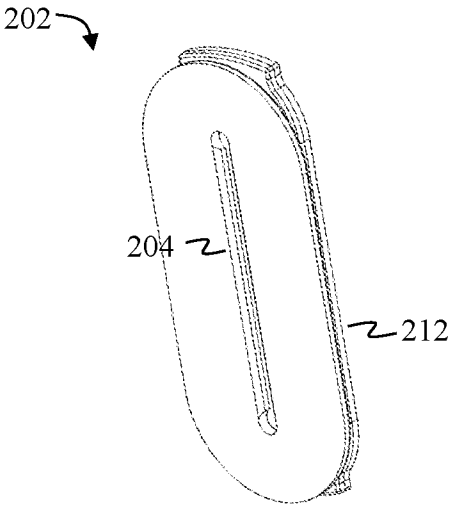
FIG. 8 is a front perspective view of the top element for the bidet attachment fastener, according to an example embodiment.
Figure 9:
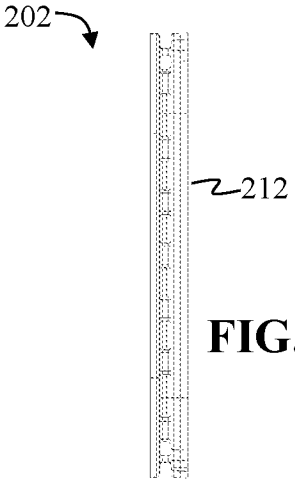
FIG. 9 is a side view of the top element for the bidet attachment fastener, according to an example embodiment.
Figure 10:
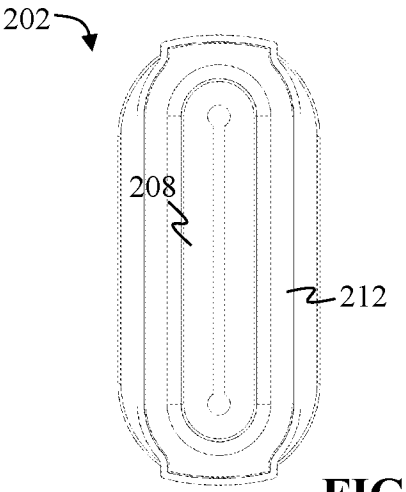
FIG. 10 is a rear view of the top element for the bidet attachment fastener, according to an example embodiment.
Figure 11:
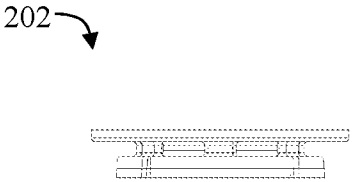
FIG. 11 is a top view of the top element for the bidet attachment fastener, according to an example embodiment.
Figure 12:
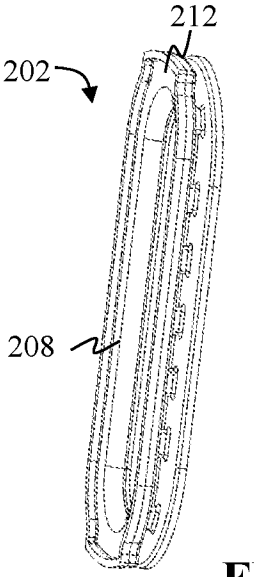
FIG. 12 is a rear perspective view of the top element for the bidet attachment fastener, according to an example embodiment.

FIGS. 7 through 12 are drawings showing different views of the top element 202 of the bidet attachment fastener 200. FIGS. 7 and 8 respectively show top and perspective views of the top element 202 including the slit 204 located centrally thereabout, with relief cutouts 210 on either side of the slit to prevent material creep tear during inserting, sliding, or removing coupling bolts. FIGS. 9 and 10 respectively show side and rear view of the same, with FIG. 11 showing a side view, further exposing the underlip 212 of the top element which is used for securing the top element into the oval depression 224 of the middle disc 220 and preventing the bidet attachment fastener 200 from being dislocated while the coupling bolt deforms the opening slot. FIG. 12 is a rear perspective view of the top element. FIGS. 10 and 12 clearly show elongated slot 208, which is commensurate with the elongated slots in the middle and base discs.

Figure 13:
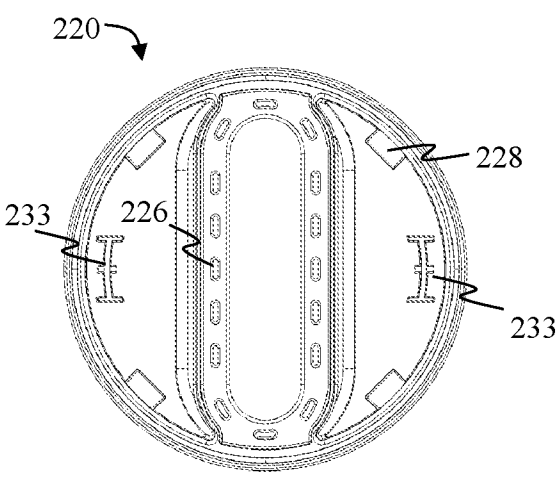
FIG. 13 is a rear view of the middle disc for the bidet attachment fastener, according to an example embodiment.
Figure 14:
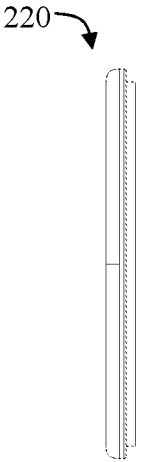
FIG. 14 is a side view of the middle disc for the bidet attachment fastener, according to an example embodiment.
Figure 15:
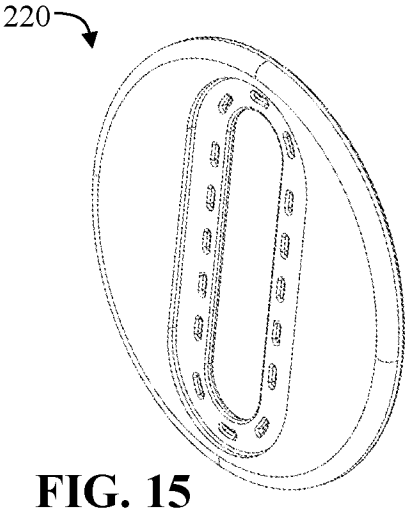
FIG. 15 is a front perspective view of the middle disc for the bidet attachment fastener, according to an example embodiment.
Figure 16:
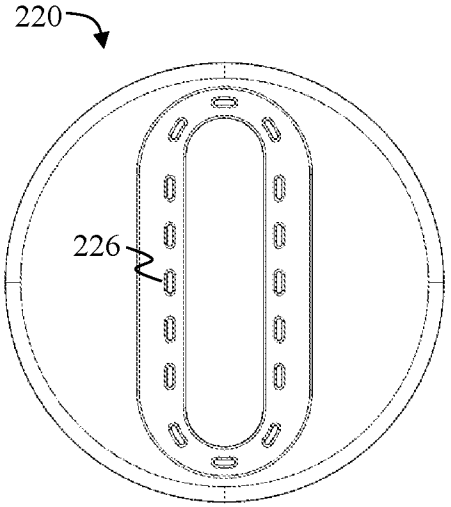
FIG. 16 is a front view of the middle disc for the bidet attachment fastener, according to an example embodiment.
Figure 17:
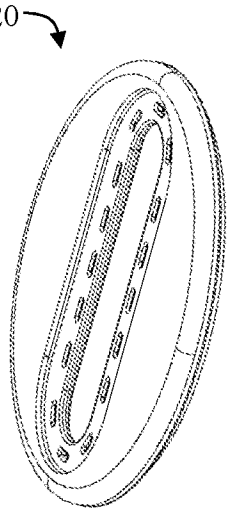
FIG. 17 is a front perspective view of the middle disc for the bidet attachment fastener, according to an example embodiment.
Figure 18:
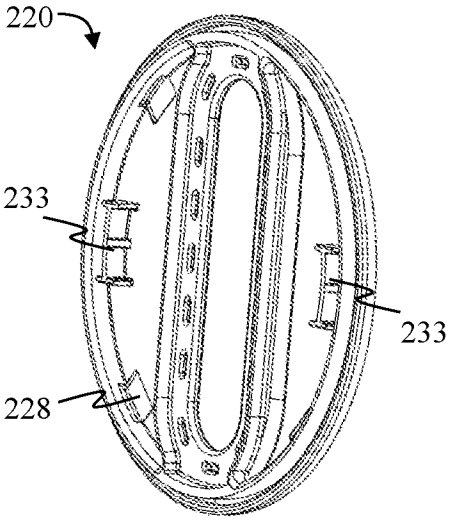
FIG. 18 is a rear perspective view of the middle disc for the bidet attachment fastener, according to an example embodiment.

FIGS. 13 through 18 are drawings depicting various different view of the middle disc 220 of the bidet attachment fastener 200. FIGS. 13 and 18 are bottom views of the middle disc, revealing the through holes or orifices 226 used to secure the top element 202 to the middle disc 220, wherein the protrusions 206 of the top element are inserted securely into the through holes or orifices 226. Undercuts 228 are aligned to allow for snap-fit connection to the base disc 230 using the snap-fit tabs 234 thereon (see FIGS. 2-6 and 21). FIG. 14 is a side view of the middle disc. FIGS. 15, 16, and 17 are top views of the middle disc shown at varying angles. FIGS. 13 and 18 further show I-beam shaped protrusions 233 on the bottom surface of the middle disc 220, which are shaped to mate with rectangular shaped cutouts 236 in the base disc 230, so as to make a friction fit.

Figure 21:
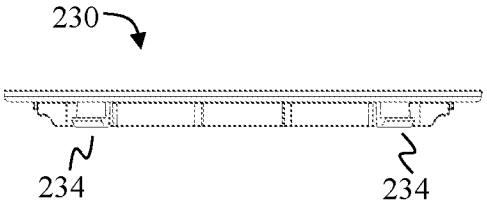
FIG. 21 is another side view of the base disc for the bidet attachment fastener, according to an example embodiment.
Figure 24:
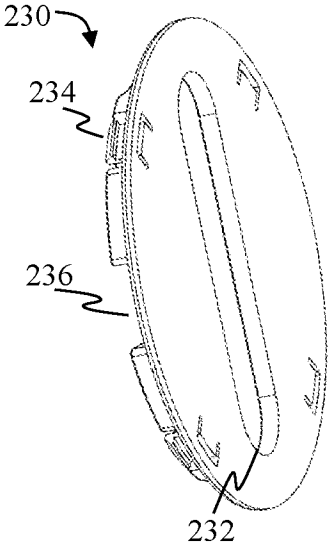
FIG. 24 is a bottom perspective view of the base disc for the bidet attachment fastener, according to an example embodiment.
Figure 20:
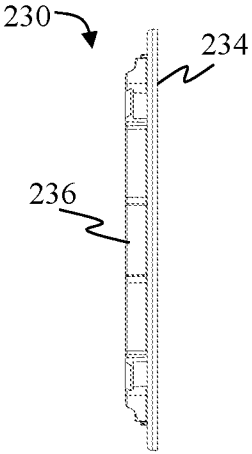
FIG. 20 is a side view of the base disc for the bidet attachment fastener, according to an example embodiment.
Figure 23:
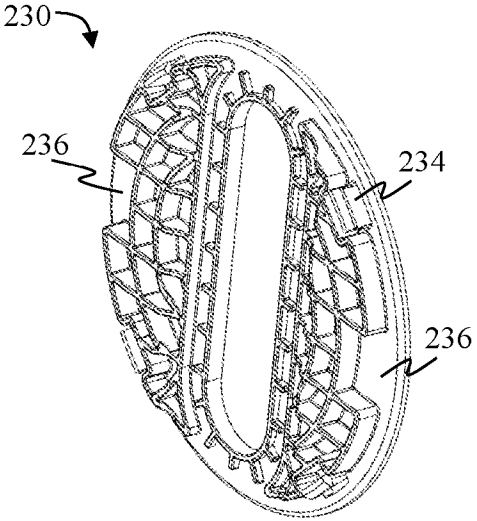
FIG. 23 is a front perspective view of the base disc for the bidet attachment fastener, according to an example embodiment.
Figure 19:
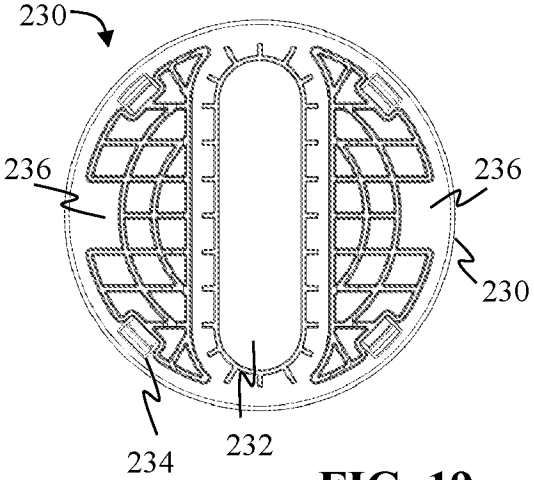
FIG. 19 is a front view of the base disc for the bidet attachment fastener, according to an example embodiment.
Figure 22:
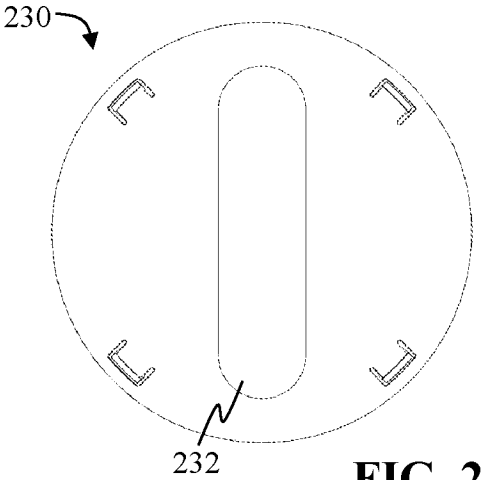
FIG. 22 is a bottom view of the base disc for the bidet attachment fastener, according to an example embodiment.

FIGS. 19 through 24 are drawings showing the bottom or base disc 230 of the bidet attachment fastener 200. FIGS. 19 and 23, respectively, are top and top perspective views of the base disc. FIGS. 19 and 23 depict snap-fit tabs 234 and rectangular cutouts 236 placed on the top surface of the base disc, which rectangular cutouts 236 are shaped to mate with the I-beam shaped protrusions 233 in the middle disc 220, so as to make a friction fit. FIGS. 20 and 21 are side views of the base disc 230, FIG. 21 showing the apparatus of FIG. 20 rotated 90 degrees upon its axis, showing in further detail the above-mentioned clips and cutouts. FIGS. 22 and 24 are, respectively, bottom and bottom-perspective views of the base disc, exposing the elongated oval slot 232 commensurate with the elongated slot 222 of the middle disc 220 and elongated slot 208 of the top element 202.

Figure 25:
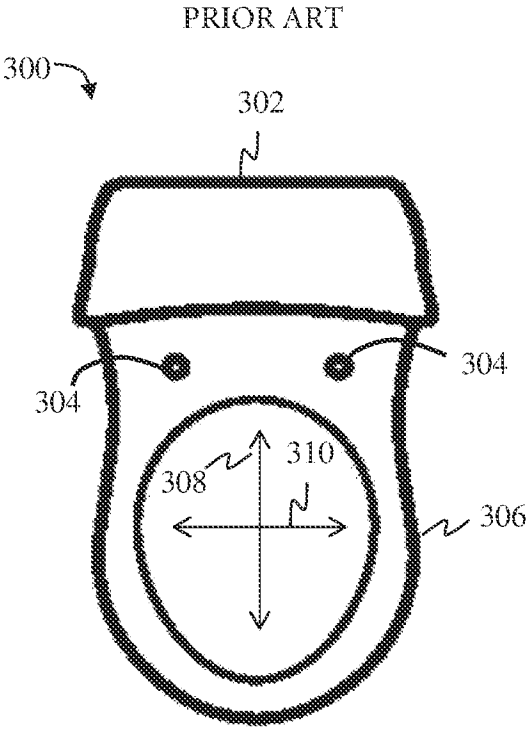
FIG. 25 is a drawing depicting a conventional toilet.

FIG. 25 is a drawing of a conventional toilet 300, including a tank 302 and a toilet bowl 306. Direction 308 moves in a forward and backwards direction while direction 310 moves in a side to side direction. Bolt holes 304 are used to fasten a toilet seat or bidet attachment to the toilet 300. While FIG. 25 shows the bolt holes 304 are a particular distance from each other (in direction 310), different toilets made by different manufactures may have different distances between the bolt holes. The same variation applies to the distance of the bolt holes from the tank (direction 308) and the distance of the bolt holes from the toilet bowl 306 (direction 308). Recall that each fastener 102, 104 is located within a circular depression in the bidet attachment 110, and each fastener 102, 104 may be rotated within the circular depression in the bidet attachment 110, so as to vary the orientation of the slots (in each fastener) in relation to each other. As the orientation of the slots is varied, so is the distance between the slots, and the locus of possible positions of the bolts within the slots. This feature allows for the placement of the bidet attachment 110 on toilets with bolt holes at different distances from one another, at different distances from the bowl of the toilet, and at different distances from the tank of the toilet While FIG. 25 represents one configuration of a conventional toilet, the drawing exists as an example demonstration of where bolt holes may be located on a conventional toilet. The claimed invention may be used with a variety of conventional toilets, allowing the placement of a bidet system on toilets with bolt holes at different distances from one another, at different distances from the bowl of the toilet, and at different distances from the tank of the toilet.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A fastener configured for fastening a bidet attachment to a toilet bowl, the fastener comprising:

a base disc having a first elongated slot, and two or more depressions on a top surface of the base disc, wherein the base disc is configured for placement within a circular depression;

a middle disc having a second elongated slot commensurate with the first elongated slot, a substantially oval depression on a top surface of the middle disc, and two or more protrusions on a bottom surface of the middle disc, where each of the two or more protrusions are configured to fit securely within the two or more depressions of the base discs when the middle disc is connected to the base disc; and a top element having a substantially oval shape configured to fit securely within the oval depression on the top surface of the middle disc, a third elongated slot commensurate with the first elongated slot, a portion of elastomeric material substantially spanning the third elongated slot, and a slit located in the portion of elastomeric material.

2. The fastener of claim 1, further comprising a bolt configured for extending through the slit located in the portion of elastomeric material.

3. The fastener of claim 2, wherein the bottom surface of the base disc is flat.

4. The fastener of claim 3, wherein the two or more depressions on the top surface of the base disc comprises rectangular shaped depressions.

5. The fastener of claim 4, wherein the two or more protrusions on the bottom surface of the middle disc are I-beam shaped and configured for securely fitting within the rectangular shaped depressions on the top surface of the base disc.

6. The fastener of claim 5, further comprising a plurality of orifices in the depression on the top surface of the middle disc.

7. The fastener of claim 6, further comprising a plurality of protrusions on a bottom surface of the top element, wherein the plurality of protrusions are configured to fit securely within the plurality of orifices in the depression on the top surface of the middle disc.

8. A bidet attachment system comprising:

a bidet attachment configured for attachment to a toilet bowl, the bidet attachment comprising a structure for spraying water, and at least one circular depression;

a fastener for fastening the bidet attachment to a toilet bowl, the fastener comprising:

a base disc having a first elongated slot, and two or more depressions on a top surface of the base disc, wherein the base disc is configured for placement within the at least one circular depression of the bidet attachment;

a middle disc having a second elongated slot commensurate with the first elongated slot, a substantially oval depression on a top surface of the middle disc, and two or more protrusions on a bottom surface of the middle disc, where each of the two or more protrusions are configured to fit securely within the two or more depressions of the base discs when the middle disc is connected to the base disc; and a top element having a substantially oval shape configured to fit securely within the oval depression on the top surface of the middle disc, a third elongated slot commensurate with the first elongated slot, a portion of elastomeric material substantially spanning the third elongated slot, and a slit located in the portion of elastomeric material.

9. The system of claim 8, further comprising a bolt configured for extending through the slit located in the portion of elastomeric material.

10. The system of claim 9, wherein the bottom surface of the base disc is flat.

11. The system of claim 10, wherein the two or more depressions on the top surface of the base disc comprises rectangular shaped depressions.

12. The system of claim 11, wherein the two or more protrusions on the bottom surface of the middle disc are I-beam shaped and configured for securely fitting within the rectangular shaped depressions on the top surface of the base disc.

13. The system of claim 12, further comprising a plurality of orifices in the depression on the top surface of the middle disc.

14. The system of claim 13, further comprising a plurality of protrusions on a bottom surface of the top element, wherein the plurality of protrusions are configured to fit securely within the plurality of orifices in the depression on the top surface of the middle disc.

* * * * *